US008978932B2

(12) United States Patent
Choquart et al.

(10) Patent No.: US 8,978,932 B2
(45) Date of Patent: Mar. 17, 2015

(54) SYSTEM AND BOTTLE FOR DISPENSING A FLUID PRODUCT

(75) Inventors: Thierry Choquart, Ramburelles (FR); Didier Klodzinski, Canny sur Matz (FR)

(73) Assignee: Albéa le Treport S.A.S (FR)

( * ) Notice: Subject to any disclaimer, the term of this patent is extended or adjusted under 35 U.S.C. 154(b) by 42 days.

(21) Appl. No.: 13/287,684

(22) Filed: Nov. 2, 2011

(65) Prior Publication Data

US 2012/0104049 A1 May 3, 2012

(30) Foreign Application Priority Data

Nov. 2, 2010 (FR) ..... 10 04301

(51) Int. Cl.
*B05B 11/00* (2006.01)
*B05B 15/00* (2006.01)

(52) U.S. Cl.
CPC ..... *B05B 11/0016* (2013.01); *B05B 11/3042* (2013.01); *B05B 11/3074* (2013.01); *B05B 15/007* (2013.01); *B05B 11/3026* (2013.01); *B05B 11/3047* (2013.01); *B05B 11/3049* (2013.01)
USPC ..... 222/321.9; 222/382; 222/464.1

(58) Field of Classification Search
CPC ..... B05B 15/007; B05B 11/0016
USPC ..... 222/321.1–321.9, 382, 385, 464.1
See application file for complete search history.

(56) References Cited

U.S. PATENT DOCUMENTS 3,658,215 A * 4/1972 Ewald ..... 222/402.18
4,475,667 A 10/1984 Ori et al.
4,801,049 A * 1/1989 Thompson ..... 222/179.5
5,769,274 A * 6/1998 Behar ..... 222/95
6,119,897 A * 9/2000 Boileau ..... 222/78
6,179,170 B1 * 1/2001 Bachand ..... 222/402.19
6,276,566 B1 * 8/2001 Zaksenberg ..... 222/78
6,488,185 B2 * 12/2002 Beranger et al. ..... 222/385

(Continued)

FOREIGN PATENT DOCUMENTS

EP 0945367 A1 9/1999
FR 2877324 A1 5/2006

(Continued)

OTHER PUBLICATIONS

French Search Report; Application No. FR 1004301; Issued: Jul. 6, 2011; 6 pages.

*Primary Examiner* — Daniel R Shearer
(74) *Attorney, Agent, or Firm* — St. Onge Steward Johnston & Reens LLC

(57) ABSTRACT

A system and bottle for dispensing a fluid product including a device for sampling the product under pressure, the device having a body incorporating a piston for dispensing which is in communication with a plunger tube, the body being provided with a vent hole which is arranged in order to make it possible to offset the volume of product distributed with air, the system further including a tube cover surrounding the plunger tube over at least one portion of its length, the tube cover being associated to the body with a bushing which has an exterior surface around which the upper end of the tube cover is arranged and an interior surface wherein the body is mounted, the interior surface having an orifice which is in communication with the vent hole, the orifice emerging into the interior surface above the exterior surface.

11 Claims, 2 Drawing Sheets

(56) References Cited

U.S. PATENT DOCUMENTS

| | | | | |
|---|---|---|---|---|
| 7,578,418 | B2 * | 8/2009 | Milian | 222/321.9 |
| 2006/0118579 | A1 * | 6/2006 | Milian | 222/321.9 |

FOREIGN PATENT DOCUMENTS

| | | | |
|---|---|---|---|
| WO | 0197979 | A1 | 12/2001 |
| WO | 2007028890 | A2 | 3/2007 |

* cited by examiner

SYSTEM AND BOTTLE FOR DISPENSING A FLUID PRODUCT

CROSS-REFERENCE TO RELATED APPLICATIONS

The present application claims priority of French patent application No. 10 04301 filed on Nov. 2, 2010, the content of which is incorporated herein by reference.

FIELD OF THE INVENTION

The invention relates to a system for dispensing a fluid product comprising a device for sampling said product under pressure. The invention also relates to a bottle for dispensing comprising such a system for dispensing which is mounted on a reservoir for conditioning the product, said reservoir being formed inside a rigid wall.

BACKGROUND OF THE INVENTION

In a particular application, the system for dispensing is intended to be provided on bottles used in perfumery, in cosmetics or for pharmaceutical treatments. Indeed, this type of bottle conventionally comprises a reservoir for conditioning the product which is returned under pressure by a device for sampling with manual actuation by means of a push-button which is arranged in order to allow for the spraying of the product.

To do this, the device for sampling has a body mounted on the reservoir, said body incorporating means for dispensing which are supplied with the conditioned product by the intermediary of a plunger tube arranged in said reservoir. Moreover, the body is provided with a vent hole which is arranged in order to make it possible to offset the volume of product distributed with air. As such, by allowing air to enter into the rigid reservoir, the vent hole prevents a vacuum from establishing inside said reservoir as dispensing takes place.

Plunger tubes are conventionally made from a thermoplastic material of the polyolefin type, i.e. they are not very transparent and retain the curvature of the storage reels. There are also plunger tubes made from fluoro-polymers which have the advantage of being practically invisible once immersed into a product, but remain visible when they are not immersed into a product.

In certain applications, in particular cosmetics, the visibility of the plunger tube through the wall of the bottle is deemed to be unsightly. In order to overcome this aesthetic problem, it has been proposed to use a tube cover surrounding the plunger tube over at least one portion of its length, said tube cover then able to be selected in order to have advantageous aesthetics in the reservoir, in particular through the use of a particular and/or decorative material on said tube cover, or in order to maintain the initially curved plunger tube in a precise position, for example in order to sample the last drop in a hollow made at the bottom of the bottle.

In particular, the tube cover can be associated to the body of the device for sampling by means of a bushing which has an exterior surface around which the upper end of the tube cover is arranged and an interior surface wherein said body is mounted. However, in such an assembly, the air return path between the vent hole and the reservoir passes through the product, which can cause problems with the product leaking as well as problems with the reliability of the air return function expected.

In order to attempt to resolve this problem, it has been proposed to make a hole in the tube cover. However, in addition to the cost for realising it in particular through the use of transformation in a metal tube, this hole can emerge into the product, in particular according to the length of the body and of the filling level of the reservoir.

Another solution proposes to create grooves on the exterior surface, said grooves forming an air return path between the vent hole and the lower end of the bushing which is arranged in the tube cover. However, the presence of grooves reduces the mechanical resistance of the bushing as well as the reliability of the maintaining of the tube cover on the body. Therefore, the grooves must be narrow and shallow which results in their filling at least partially with the product via the phenomenon of capillarity.

However, when there is an increase in temperature, the volume of the conditioned product increases via dilatation and even more so if it contains alcohol. This then results in a pressure inside the reservoir which, according to the rise in temperature, can commonly reach 5 or 6 bars according to the product volume/air volume ratio above the product. Furthermore, a pressure differential between the interior of the container and the exterior is also formed at altitude.

Before the use users such a bottle under pressure, the air contained in the space V1 located above the product outside of the tube cover is at the same pressure as the air contained in the space V2 located above the product in the tube cover.

When the user uses the bottle, he presses the push-button, and therefore the path towards the vent hole is open. Through the balancing of the pressures with the outside air, air contained in the volume V2 escapes through the vent hole, the pressure in V2 falls, but as the grooves are partially filled with the product, the air flow through the grooves is very low. The air pressure in V1 is applied over the surface of the product, the level of liquid rises in the space V2 and passes through the air return path to the exterior. This phenomenon takes place is a few tenths of a second and causes the product to leak.

SUMMARY OF THE INVENTION

The invention aims to perfect the prior art by proposing in particular a system for dispensing wherein a cover of the plunger tube is maintained in a reliable manner on the body of a device for sampling with air return, and this without the risk of a product leak or hindering the air return function.

To this effect, and according to a first aspect, the invention proposes a system for dispensing a fluid product comprising a device for sampling said product under pressure, said device having a body incorporating means for dispensing which are in communication with a plunger tube, said body being provided with a vent hole which is arranged in order to make it possible to offset the volume of product distributed with air, said system further comprising a tube cover surrounding the plunger tube over at least one portion of its length, said tube cover being associated to the body by means of a bushing which has an exterior surface around which the upper end of the tube cover is arranged and an interior surface wherein said body is mounted, the interior surface having an orifice which is in communication with the vent hole, said orifice emerging into the interior surface above the exterior surface.

According to a second aspect, the invention proposes a bottle for dispensing a fluid product comprising a reservoir for conditioning said product which is formed inside a rigid wall and transparent or at least translucent, said bottle further comprising such a system for dispensing which is mounted on the reservoir with the plunger tube arranged in said reservoir, an air return path being formed between the vent hole and said reservoir by the intermediary of the communication orifice.

BRIEF DESCRIPTION OF THE DRAWINGS

Other purposes and advantages of the invention shall appear in the following description, which is provided in reference to the annexed figures, wherein.

DETAILED DESCRIPTION OF THE INVENTION

Figure 1:
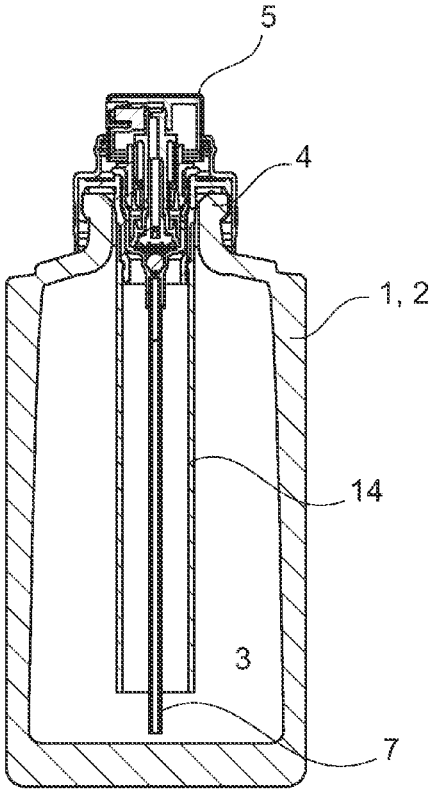
FIG. 1 is a longitudinal section view of a bottle for dispensing according to an embodiment of the invention.

In the description, the terms of positioning in space are taken in reference to the position of the bottle shown in FIG. 1. Moreover, for reasons of clarity, the product is not shown in FIG. 2.

In relation to the figures, described hereinbelow is a bottle intended to contain a fluid product for the purposes of dispensing it, as well as a system for dispensing such a product. In particular examples, the product can be liquid, in particular a cosmetic care, make-up or perfuming product, or a pharmaceutical product.

The bottle comprises a body 1 having a rigid wall 2 wherein a reservoir 3 for conditioning the product is formed, said body further having a neck 4 which overmounts said reservoir. In particular, the body 1 has a rigidity that is sufficient for the volume of the reservoir 3 to remain substantially constant. Furthermore, the wall 2 can be transparent or at least translucent in order to allow for the visualisation of the conditioned product through it.

The body 1 can be made in a one-piece manner, for example made through injection-blow moulding or extrusion-blow moulding, or in several parts that are injected and then assembled, for example via ultrasonic sealing, made of rigid plastic material that is at least translucent or of glass.

The bottle further comprises a system for dispensing which is mounted on the reservoir 3, said system comprising a device for sampling the conditioned product under pressure. In the embodiment shown, the device for sampling comprises a pump for dispensing that is actuated manually by means of a push-button 5 which is supplied with the product under pressure for the purposes of dispensing it.

The device for sampling has a body 6 incorporating means for dispensing which are in communication with a plunger tube 7 by the intermediary of a valve 8, said plunger tube being arranged in the reservoir 3 in order to make possible the supplying of the means for dispensing with conditioned product. The body 6 is provided with a vent hole 9 which is arranged in order to make it possible to offset the volume of product distributed with air, in order to prevent a vacuum from being established inside the rigid reservoir 3 as the dispensing progresses.

In the embodiment shown, the body 6 has a cylindro-conical geometry comprising a central zone 6*a* connected to an upper zone 6*b* by the intermediary of a divergent fillet 6*c*. Moreover, the body 6 has a tubing 6*d* wherein the plunger tube 7 is press-fitted, said tubing being connected below the central zone 6*a* by the intermediary of a seat 6*e* wherein a ball 8 forming a valve is arranged. Moreover, the vent hole 9 is formed in the upper end of the central zone 6*a*.

Figure 2A:
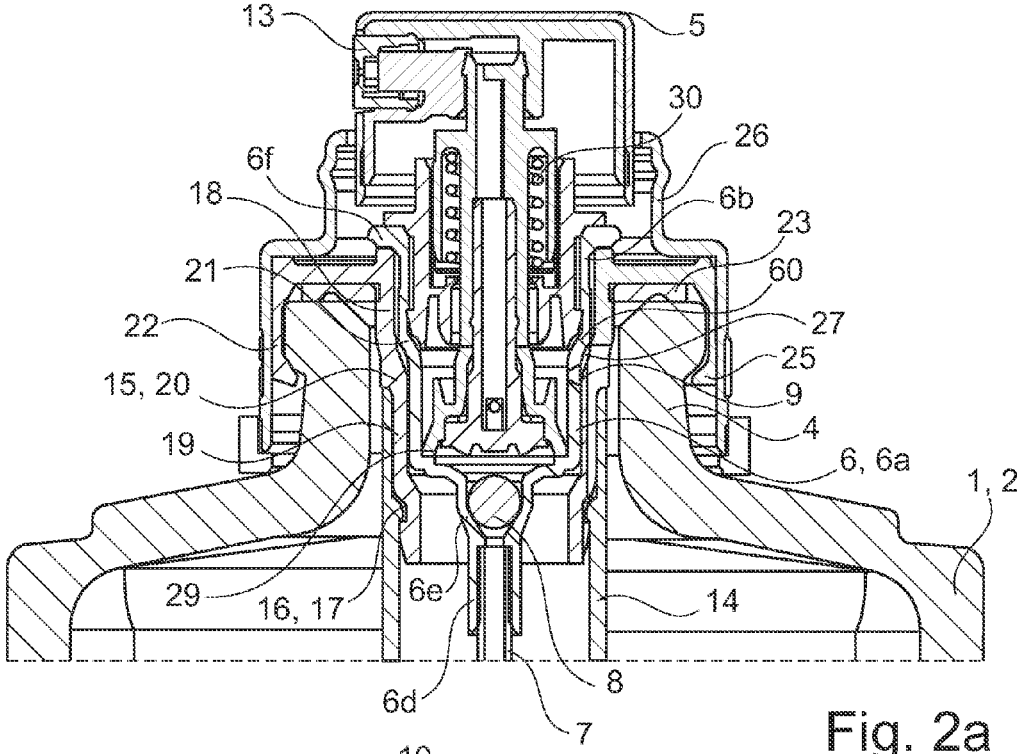
FIGS. 2*a* and 2*b* are enlarged views of FIG. 1 showing more particularly the system for dispensing with the push-button pushed.
Figure 2B:
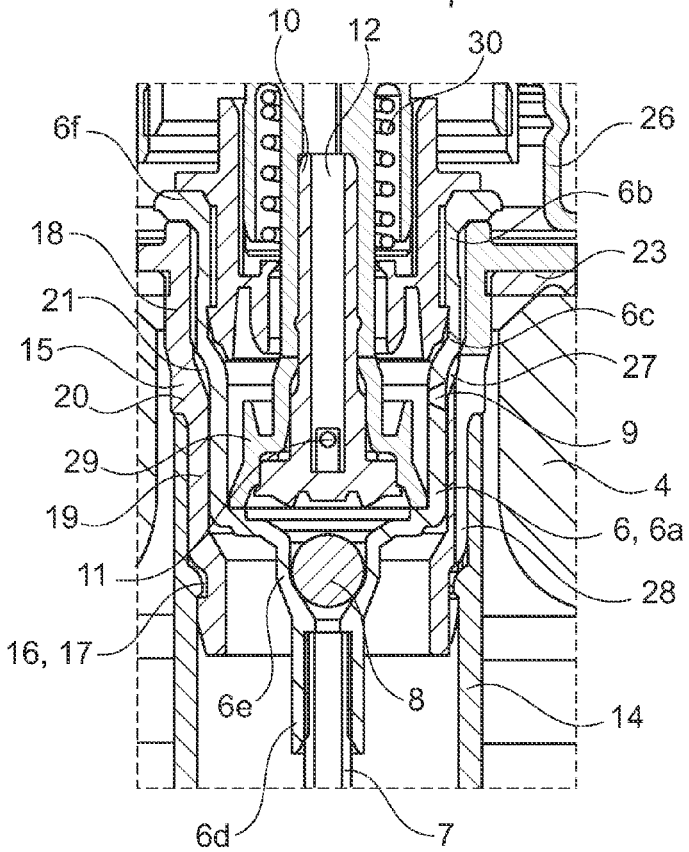

In relation with FIG. 2*b*, the means for dispensing include a piston 29 which is mounted in sealed translation in the central zone 6*a* by delimiting a metering chamber in communication with the plunger tube 7 by the intermediary of the valve 8. The piston 29 is arranged on a nozzle 10 that is integral with the push-button 5 in order to be actuated in reversible translation in relation to body 6, over a stroke respectively for dispensing and for sucking the product.

The nozzle 10 has a path for dispensing comprising at least one upstream orifice 11 and a channel 12 of which the downstream end is in communication with the push-button 5, the piston 29 being arranged in order to have a state for sealing of the upstream orifice 11 and a state for putting into communication of said upstream orifice with the metering chamber. In particular, the piston 29 can be deformed and/or displaced under the effect of the compression of the product in the metering chamber.

The push-button 5 comprises an upper zone making it possible for the user to press with their finger on said push-button in order to axially displace the nozzle 10, the return of said push-button on the suction stroke being conventionally carried out by a spring 30. In FIGS. 1 and 2, the nozzle 10 is shown at the end of the dispensing stroke.

The push-button 5 is provided with a spray nozzle 13 which is arranged in order to radially distribute an aerosol of the product. However, the invention is not limited to a particular embodiment of dispensing of the product. In particular, especially for a nose spray tip, the push-button 5 can make possible an axial dispensing of the product and another type of device for sampling can be considered.

The system for dispensing further comprises a tube cover 14 surrounding the plunger tube 7 over at least one portion of its length. In particular, the tube cover 14 makes it possible to conceal the plunger tube 7 inside the reservoir 3, said tube cover then being selected in order to have an advantageous aesthetics in said reservoir, for example through the use of a particular material, in particular metal, and/or by the realisation of decorations or visual effects on said tube cover.

In relation with FIG. 1, the plunger tube 7 extends substantially to the bottom of the reservoir 3 and the tube cover 14 surrounds said plunger tube over substantially its entire length allowing the lower end of said plunger tube to protrude via which the product is sucked. Moreover, the tube cover 14 has a cylindrical geometry of revolution with an inside diameter that is adapted for the arrangement of the plunger tube 7 inside. Alternatively, the tube cover 14 can have any extended geometry wherein the plunger tube 7 can be arranged for the purposes of concealing it at least partially or maintaining it in a precise position.

The tube cover 14 is associated to the body 6 by means of a bushing 15 which has an exterior surface 15*a* around which the upper end of the tube cover 14 is arranged and an interior surface 15*b* wherein said body is mounted. The bushing 15 can be carried out in a one-piece manner made of ductile material, in particular through moulding of a plastic material of the polyolefin type.

In the embodiment shown, the bushing 15 has a lower annular groove 16 wherein a ring 17 formed inside the tube cover 14 is engaged in order to provide the axial maintaining of said tube cover on said bushing. Moreover, the ring 17 delimits the upper end of the tube cover 14 which is arranged around the exterior surface 15*a*, said upper end having an inside diameter which is greater than the inside diameter of the tube cover 14 which extends below said ring.

Figure 3A:
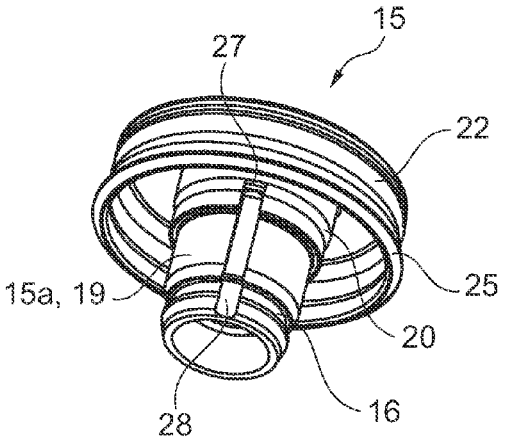
FIG. 3 are views of the bushing of association of the tube cover of the bottle for dispensing according to FIG. 1, respectively in perspective from below (FIG. 3*a*) and as a longitudinal section (FIG. 3*b*).
Figure 3B:
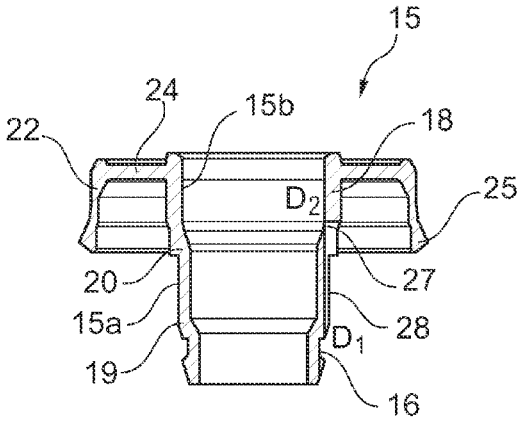

In relation with FIG. 3, the bushing 15 has an upper ring 18 which overmounts a sleeve 19, said upper ring being connected to said sleeve by a converging fillet 20. The exterior surface 15*a* is then formed around the sleeve 19 and the interior surface 15*b* extends inside the ring 18 and said sleeve. In particular, the tube cover 14 and the central zone 6*a* extend radially facing a portion that is respectively exterior and interior of the sleeve 19.

In the embodiment shown, the central zone 6*a* is arranged in the sleeve 19 and the upper zone 6*b* is arranged in the upper ring 18 in such a way that the vent hole 9 is arranged radially facing the fillet 20. More precisely, the upper zone 6*b* has an upper flange 6*f* which is in axial engagement on the upper end of the ring 18 with the push-button 5 arranged above the bushing 15. Furthermore, the geometries of the peripheries respectively exterior of the body 6 and interior of the bushing 15 are arranged in order to form an annular clearance 21 between the vent hole 9 and the fillet 20.

Moreover, the bushing 15 has a outer skirt 22 which surrounds the upper ring 18, said outer skirt comprising means of fastening of said bushing on the reservoir 3. In the embodiment shown, the system of dispensing is mounted on the reservoir 3 by the intermediary of the bushing 15 by placing the upper end of the neck 4 between the outer skirt 22 and the upper ring 18. Furthermore, a sealing joint 23 is inserted between the upper surface of the neck 4 and the lower surface of the connection surface 24 of the outer skirt 22 to the upper ring 18.

In the embodiment shown, the skirt 22 is provided with an edge 25 for fastening under the neck 4 which is arranged radially facing the fillet 20. In a known manner, the edge 25 is protruding from the outer skirt 22 in order to allow for the positioning of the bushing 15 on the neck 4 then, as shown in FIGS. 1 and 2, folded back to the position of fastening under said neck via the sliding of a hoop 26 around said skirt. Alternatively, the skirt 22 can be positioned via snap-fitting on the neck 4, said snap fitting being made reliable via a hoop 26.

The interior surface 15*b* has an orifice 27 which is in communication with the vent hole 9, said orifice emerging in the interior surface 15*b* above the exterior surface 15*a* and therefore above the tube cover 14. In particular, the orifice 27 is formed in the fillet 20 in order to be in communication with the vent hole 9 by the intermediary of the annular clearance 21. Alternatively, several communication orifices 27 can be distributed over the interior surface 15*b*.

As such, an air return path is formed between the vent hole 9 and the reservoir 3 by the intermediary of the communication orifice 27, said path not passing through the inside of the tube cover 14 in such a way as to prevent product leaks while still making reliable the air return function. In particular, the communication orifice 27 is arranged in the neck 4, well above the product, in such a way as to prevent any risk of invasion by the product.

In the embodiment shown, the bushing 15 has a groove 28 which extends axially over the exterior surface 15*a*, said groove having an upper extension which is formed above said exterior surface, the communication orifice 27 being realised in said extension. Furthermore, the axial groove 28 emerges axially at the lower portion of the bushing 15 in order to be in communication with the space located above the product in the tube cover 14. Alternatively, several grooves 28 can be provided on the bushing 15, a communication orifice 27 being formed in an upper extension of each of said grooves.

As such, even if the groove is filled at least partially with the product via the phenomenon of capillarity, the balancing of the pressure during the actuation of the push-button 5 is carried out through the communication orifice 27 with a sufficient amount of air flow to prevent the product from leaking.

In a manner that is advantageous for the carrying out of the communication orifice 27 during the manufacture via moulding of the bushing 15, the upper ring 18 has an inside diameter D2 and the groove 28 has a bottom which is inscribed in a diameter D1. As such, when the diameter D1 is less than or equal to the diameter D2, the communication orifice 27 is formed through interference of said diameters in the zone of the bottom of the groove 28 which extends over the fillet 20.

What is claimed is:

1. A system for dispensing a fluid product, comprising:

a device for sampling said product under pressure, said device having a body incorporating a dispenser in communication with a plunger tube, said body being provided with a vent hole which is arranged to offset the volume of product distributed with air;

a tube cover surrounding the plunger tube over at least one portion of its length, said tube cover having an open lower end through which the plunger tube receives said product, said tube cover being associated with the body by means of a bushing which has an exterior surface around which an upper end of the tube cover is arranged and an interior surface wherein said body is mounted;

characterised in that the interior surface has an orifice which is in communication with the vent hole and forming an air return path via the vent hole and the orifice, said orifice emerging in the interior surface above the exterior surface and adjacent to the vent hole;

further characterised in that the bushing has a groove which extends axially over the exterior surface, said groove having an upper extension which is formed above said exterior surface, the orifice being realised in said extension; and further characterised in that the bushing has an upper ring which overmounts a sleeve, the upper ring being connected to the sleeve by a fillet wherein the communication orifice is formed and the exterior surface being formed around said sleeve and the interior surface extending inside said ring and said sleeve.

2. The system for dispensing according to claim 1, characterised in that the upper ring has an inside diameter D2 and the groove has a bottom which is inscribed in a diameter D1, said diameter D1 being less than or equal to the diameter D2 in such a way as to form the communication orifice in the zone of the bottom on the groove which extends over the fillet.

3. The system for dispensing according to claim 1, characterised in that the vent hole is arranged radially facing the fillet.

4. The system for dispensing according to claim 3, characterised in that an annular clearance is formed between the vent hole and the fillet.

5. The system for dispensing according to claim 1, characterised in that the bushing has a lower annular groove wherein a ring formed inside the tube cover is engaged in order to provide the maintaining of said tube cover on the bushing.

6. The system for dispensing according to claim 1, characterised in that the axial groove emerges axially at the lower portion of the bushing.

7. The system for dispensing according to claim 1, characterised in that the bushing has an outer skirt which comprises a fastener to fasten said bushing on a reservoir of product to be dispensed.

8. The system for dispensing according to claim 1, characterised in that the dispenser includes a piston which is mounted in sealed translation in the body by delimiting a metering chamber in communication with the plunger tube, said piston being arranged on a nozzle that is integral with a push-button in order to be actuated in reversible translation in relation to said body, said nozzle having a dispensing path comprising at least one upstream orifice and a channel of which the downstream end is in communication with the push-button, said piston being arranged in order to have a state for sealing of the upstream orifice and a state of putting into communication of said upstream orifice with the metering chamber.

9. A bottle for dispensing a fluid product comprising a reservoir for conditioning said product which is formed inside a rigid wall, said bottle further comprising a system for dispensing according to claim 1 which is mounted on the reservoir with the plunger tube arranged in said reservoir, the air return path being formed between the vent hole and said reservoir by the intermediary of the communication orifice.

10. The bottle for dispensing according to claim 9, characterised in that the reservoir is surmounted by a neck wherein the communication orifice is arranged.

11. The bottle for dispensing according to claim 9, characterised in that the system for dispensing is mounted on the reservoir by the intermediary of the bushing.

* * * * *